United States Patent [19]

Mierswa et al.

[11] Patent Number: 4,691,723

[45] Date of Patent: Sep. 8, 1987

[54] APPARATUS FOR CLEANING RADIOACTIVE TUBE BANKS

[75] Inventors: Christian Mierswa, Binzen; Friedrich Schmutz, Weil am Rhein, both of Fed. Rep. of Germany

[73] Assignee: Ernst Schmutz GmbH, Weil am Rhein, Fed. Rep. of Germany

[21] Appl. No.: 732,258

[22] Filed: May 9, 1985

[30] Foreign Application Priority Data

May 21, 1984 [DE] Fed. Rep. of Germany ..... 34188355

[51] Int. Cl.[4] ..... B08B 3/02

[52] U.S. Cl. ..... 134/167 C; 134/168 C; 134/172; 239/DIG. 13; 239/753; 118/306; 118/317; 118/323; 15/104.1 R; 15/104.16

[58] Field of Search ..... 134/167 R, 167 C, 172, 134/174, 123, 166 C, 168 R, 168 C, 180, 181; 165/95; 15/104.12, 302, 315, DIG. 2, 104.1 R, 104.15, 104.2; 239/DIG. 13, 178, 186, 187; 414/749; 301/17; 118/306, 317, 323

[56] References Cited

U.S. PATENT DOCUMENTS

| | | | |
|---|---|---|---|
| 1,476,901 | 12/1923 | McCarty | 15/104.1 R |
| 2,735,794 | 2/1956 | Fletcher . | |
| 3,354,490 | 11/1967 | Masters et al. | 15/104.1 R |
| 3,443,993 | 5/1969 | Lynn et al. | 134/123 |
| 3,448,477 | 6/1969 | Ricordeau et al. . | |
| 3,511,251 | 5/1970 | Hickman | 134/123 |
| 3,655,122 | 4/1972 | Brown et al. | 134/167 C X |
| 3,736,909 | 6/1973 | Marangoni et al. . | |
| 3,794,051 | 2/1974 | Lee, Jr. et al. | 134/167 C X |
| 3,903,912 | 9/1975 | Ice . | |
| 3,922,991 | 12/1975 | Woods | 134/172 X |
| 3,934,731 | 1/1976 | Muller et al. | 414/749 |
| 4,095,305 | 6/1978 | Goodwin | 15/104.1 R |
| 4,163,455 | 8/1979 | Hebert | 134/167 R |
| 4,169,758 | 10/1979 | Blackstone et al. | 901/17 X |
| 4,311,556 | 1/1982 | Iwamoto et al. | 901/17 X |
| 4,343,059 | 8/1982 | Simpson | 15/104.1 R X |
| 4,496,519 | 1/1985 | McGuire | 134/168 R X |

FOREIGN PATENT DOCUMENTS

| | | | |
|---|---|---|---|
| 2219847 | 10/1973 | Fed. Rep. of Germany | 134/167 C |
| 2016172 | 9/1979 | United Kingdom . | |
| 2093145 | 8/1982 | United Kingdom . | |

*Primary Examiner*—Harvey C. Hornsby
*Assistant Examiner*—Frankie L. Stinson
*Attorney, Agent, or Firm*—Fleit, Jacobson, Cohn & Price

[57] ABSTRACT

Apparatus for cleaning radioactive tube banks which have open ends contained in a plane, preferably for cleaning the tube banks of tube bank condensers, includes a high-pressure hose, which is pushed through each of the tubes and which at its free end carries a spray nozzle for discharging a cleaning liquid. The hose is disposed between and positively or non-positively coupled to two feed wheels and is advanced and retracted by the feed wheels in a direction which is parallel to the tubes. The feed wheels are provided with a hose drive and mounted in a cleaning carriage, which is movable by a carriage drive in a plane which is defined by a frame. The cleaning carriage is fixed in cleaning positions, and the frame is provided with a device for fixing the frame to the tube bank.

6 Claims, 4 Drawing Figures

APPARATUS FOR CLEANING RADIOACTIVE TUBE BANKS

BACKGROUND OF THE INVENTION

1. Field of the Invention

This invention relates to apparatus for cleaning radioactive tube banks which have open ends contained in a plane, preferably for cleaning the tube banks of tube bank condensers, comprising a high-pressure hose, which is adapted to be pushed through each of the tubes and which at its free end carries a spray nozzle for discharging a cleaning liquid.

2. Description of the Prior art

Water contaminated with radioactive material becomes available at a high rate, e.g., in nuclear power plants, and is decontaminated by evaporation. A large part of that water consists of rinsing water, which has been used to clean radioactive parts of the plant or clothes and which contains radioactive particles. As the water is evaporated, such radioactive particles are deposited on the tubes of the evaporator and of the condenser used to condense the water vapor so that said particles constitute insulating layers, which obstruct the heat transfer. In order to ensure that heat exchangers, evaporators, condensers and other equipment used to conduct radioactive water will be maintained in an operative condition, such equipment must be cleaned from time to time. In the present practice such cleaning is effected in that the tube banks, e.g., of a condenser, are opened and a high-pressure hose provided at its free end with a spray nozzle is pushed through each tube so that the water which in the high-pressure hose may be under a pressure of about 400 to 700 bars and which is sprayed from the spray nozzle will detach the deposits from the inside surfaces of the tube. That rinsing water consists of entirely desalted water. As the operator is exposed to the strong radioactive radiation leaving the open head of the condenser, an operator can perform such work only for a short time and must often be relieved.

SUMMARY OF THE INVENTION

It is an object of the invention to provide an apparatus which is of the kind described first hereinbefore and can be used to clean tube banks substantially without a need for a performance of manual work close to the tube bank.

In an apparatus which is of the kind described first hereinbefore that object is accomplished in that the hose is disposed between the positively or non-positively coupled to two feed wheels and is adapted to be advanced and retracted by said feed wheels in a direction which is parallel to the tubes, said feed wheels are provided with a hose drive and mounted in a cleaning carriage, which is movable by a carriage drive in a plane which is defined by a frame, said cleaning carriage is adapted to be fixed in cleaning positions, and the frame is provided with means for fixing the frame to the tube bank. The carriage which carries the high-pressure hose provided with the spray nozzle can be moved under the control of control means to cleaning positions, in which said hose is axially aligned with respective tubes of the bank, and the hose is then moved once or several times through the respective tube. Manual work is required only to open the tubes and to fix the frame which carries the cleaning carriage.

The carriage is provided with feed wheels or with different means for advancing and retracting the pressure hose and the latter carries at its free end a nozzle, which preferably has a plurality of orifices, through which the cleaning liquid is sprayed under a high pressure against the inside surface of each tube.

The cleaning carriage may be movable in a guiding carriage, which is movable at right angles to the direction of movement of the cleaning carriage.

The tracks for guiding the cleaning carriage and or guiding carriage may be secured to carriers, which are rotatably mounted on the frame, which is provided with a circular track. If the cleaning carriage is radially movable along the rotatable carrier, the cleaning carriage can scan the entire plane containing the open ends of the tubes to be cleaned in that the carriers are rotated and the cleaning carriage is radially moved. If the tracks for the guiding carriage are rotatably mounted, the cleaning carriage can be caused to scan a quadrant in that the carriers are moved through a quarter of a revolution.

In a preferred embodiment each track consists of a tube and the cleaning carriage and/or the guiding carriage and/or the carrier carrying said carriage or each of said carriages is provided with at least three pairs of rollers, which engage the track tubes on opposite sides. The accuracy and stability of the guiding system will be further increased if a third roller arranged beside each pair of rollers engages the track on a third side and takes up forces acting, e.g., in a transverse direction.

The high-pressure hose may be movable by means of two friction wheels, which are driven by a rotary hydraulic motor mounted on the cleaning carriage.

Within the scope of the invention the cleaning carriage carries a television camera and lamps so that the movements of the cleaning carriage can be exactly controlled by an operator at a remote control station.

Fluid-operated piston-cylinder units may be provided for moving the carriages relative to each other and to the frame.

DETAILED DESCRIPTION OF THE PREFERRED EMBODIMENT

Figure 1:
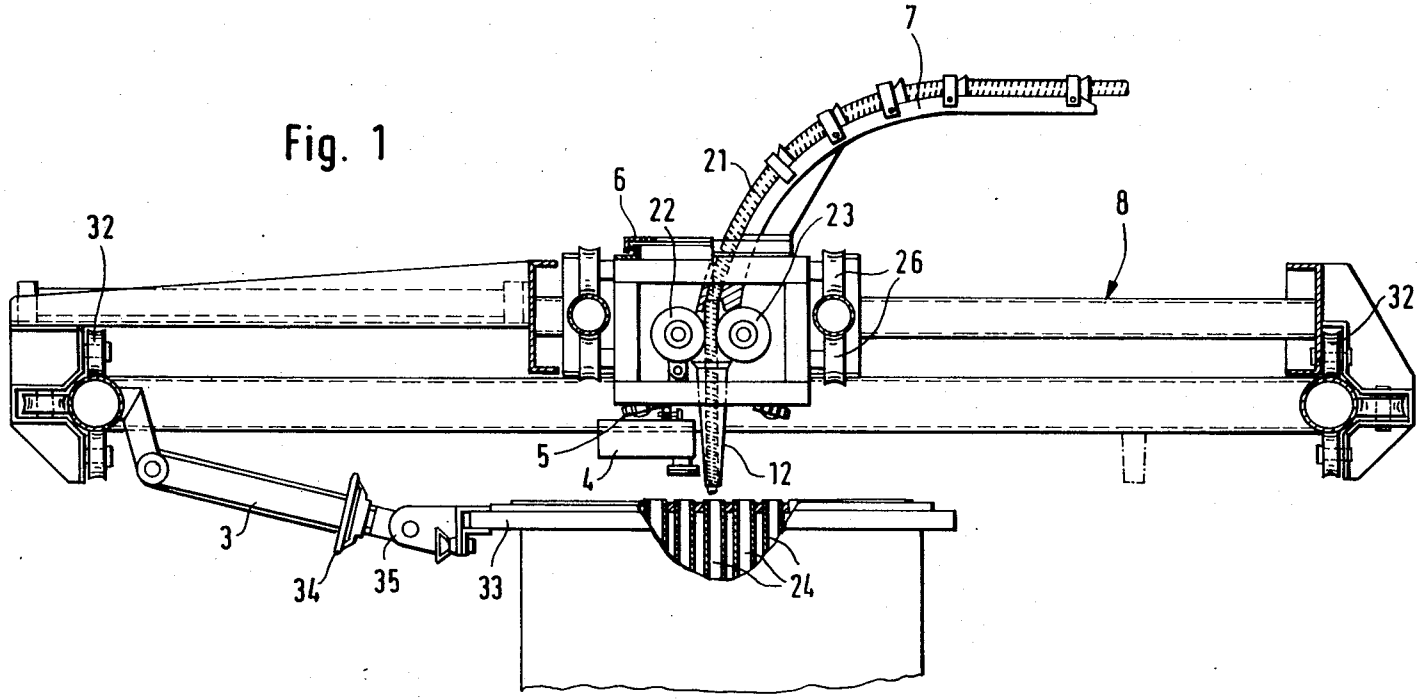
FIG. 1 is a side elevation showing the cleaning apparatus partly in section.
Figure 2:
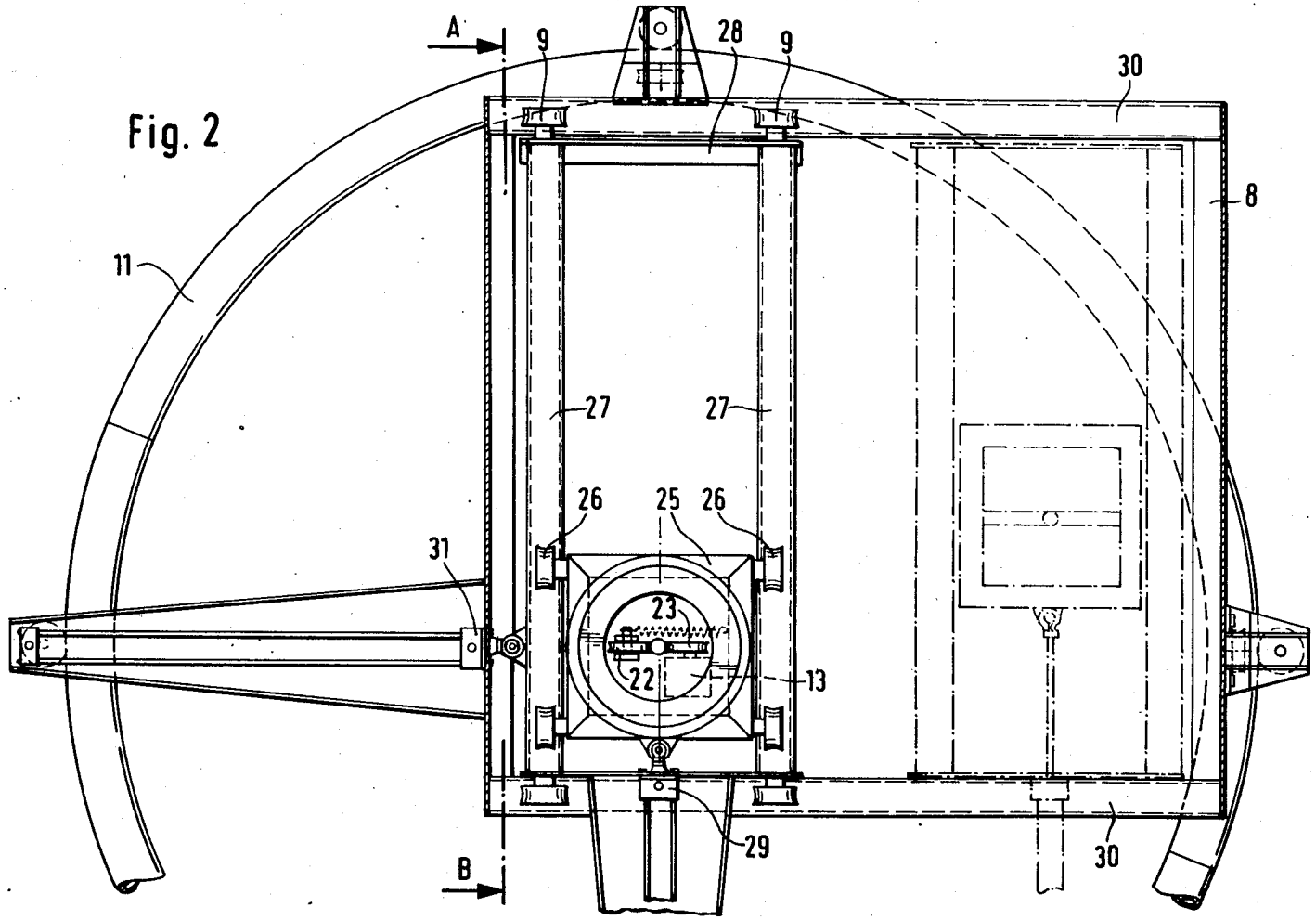
FIG. 2 is a top plan view showing the cleaning apparatus of FIG. 1.
Figure 3:
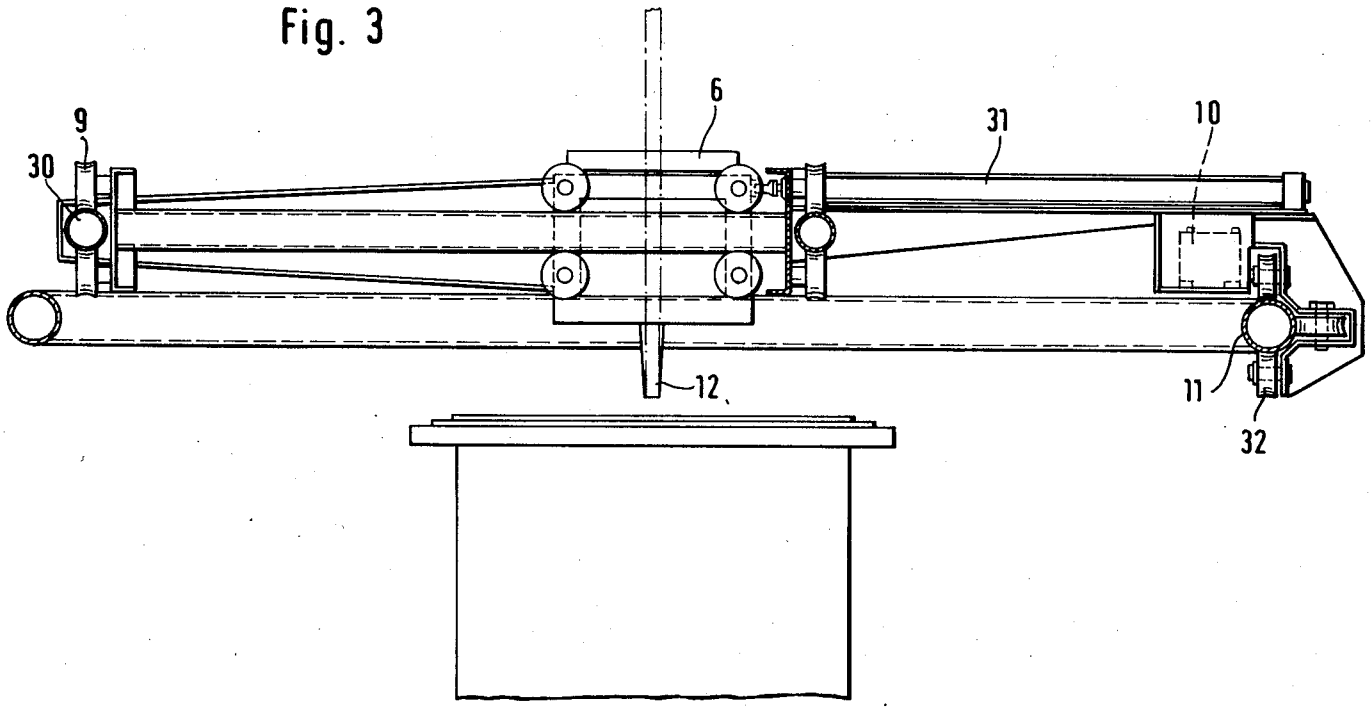
FIG. 3 is a sectional view taken on line A-B in FIG. 2.
Figure 4:
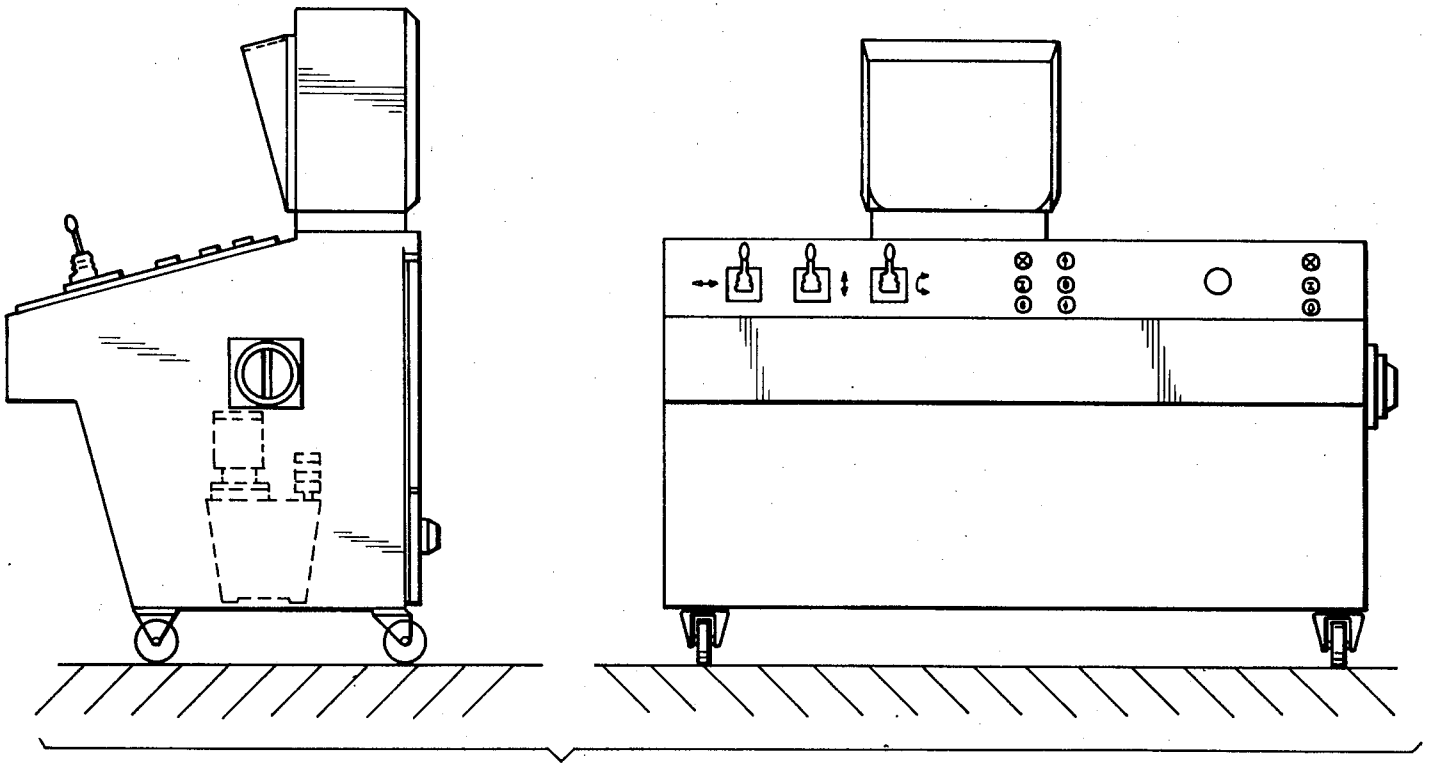
FIG. 4 is a front elevation and a side elevation diagrammatically showing a remote control unit.

An illustrative embodiment of the invention will now be explained more fully with reference to the drawing.

As is apparent in FIG. 1 a pressure hose 21 is moved in a direction which is parallel to condenser tubes 24 by means of two feed wheels 22, 23, one of which, 23, is driven by a rotary hydraulic motor 13. The pressure hose 21 extends through and is guided by a sleeve 12. To permit an exact control of the insertion of the pressure hose 21 into each condenser tube 24, the cleaning carriage 25 carrying the wheels 22, 23, the motor 13 and the sleeve 12 is provided on its underside with a television camera 4 and two lamps 5.

The cleaning carriage is supported by rollers 26 on tracks 27 of a track frame or intermediate carriage 28 and is moved along said tracks 27 by a piston-cylinder unit 29.

The track frame 28 is supported by rollers 9 on tracks 30 of a main frame 8 and is moved along the tracks 30 by a piston-cylinder unit 31.

The main frame 8 is rotatably mounted on an annular centering tube 11, which supports rollers 32 mounted on the main frame 8. Drive unit 10 rotates main frame 8 along annular centering tube 11.

Four angularly spaced apart telescopic arms 3 are connected to the annular centering tube 11 and can be used to secure the apparatus to the flange 33 of the tube bank which is to be cleaned. For this purpose each telescopic arm 3 is provided at its inner end with a fixing lug 35, which is pivoted to the flange 33 of the tube bank. Each of the telescopic arms comprises a screw, which is operable by means of a handwheel 34 for adjusting the cleaning apparatus and for fixing it in the adjusted position.

In order to prevent a twisting and entangling of the pressure hose 21, the latter is guided by an arcuate guide 7 to the cleaning carriage and extends through a ring 6, which is freely rotatably mounted on the cleaning carriage 25.

The entire apparatus is controlled from a room that is shielded from the environment and contains means for controlling all movements of the cleaning apparatus, namely, the advancing and retracting of the pressure hose 21 into and out of the condenser tubes 24, the movement of the cleaning carriage 25 along the tracks 27, the movement of the track frame 28 along the tracks 30 and the rotation of the main frame 8. That control room also contains switches for energizing and de-energizing the cleaning liquid and a monitor coupled to the television camera 4.

Safety devices are also provided, such as limit switches for preventing an impact in the various directions of movement. A limit switch may also be used to energize and de-energize the high-pressure pump for the cleaning liquid.

In the embodiment shown by way of example each track is engaged by a plurality of angularly spaced apart rollers to ensure a smooth guidance under loads applied in various directions.

We claim:

1. Apparatus for cleaning radioactive contaminated banks of tubular members which have open ends located in a plane, said apparatus comprising:

hose means for spraying a cleansing liquid, feed means for feeding said hose means in a direction parallel to a longitudinal axis at said tubular members, a cleaning carriage, said feed means being mounted on said cleaning carriage, an intermediate carriage, said cleaning carriage being slidably mounted on said intermediate carriage, first drive means for moving said cleaning carriage in a straight line on said intermediate carriage, a main carriage, said intermediate carriage being slidably mounted on said main carriage, second drive means for moving said intermediate carriage on said main carriage in a straight line normal to a direction of movement of said cleaning carriage, a circular centering ring, said main carriage being rotatably mounted on said circular centering ring, and third drive means for rotating said main carriage on said circular centering ring to thereby simultaneously rotate said cleaning carriage and said intermediate carriage.

2. The apparatus according to claim 1, wherein said hose means includes a high pressure hose and a spray nozzle mounted at one end of said hose.

3. The apparatus according to claim 1, wherein said feed means includes two rollers coupled to said hose means on opposite sides of said hose means.

4. The apparatus according to claim 3, wherein said two rollers are driven by a rotary hydraulic motor mounted on said cleaning carriage.

5. The apparatus according to claim 1, wherein a television camera is mounted on said cleaning carriage to guide a remote control positioning of said hose means.

6. The apparatus according to claim 5, wherein movement of said cleaning carriage, said intermediate frame and said main frame are controlled by a remote controlled unit including a television monitor to view an image from said television camera.

* * * * *